US006213640B1

(12) United States Patent
Bois

(10) Patent No.: US 6,213,640 B1
(45) Date of Patent: Apr. 10, 2001

(54) BAG SUSPENDING DEVICE

(75) Inventor: Henri Bois, Neuilly-sur Seine (FR)

(73) Assignee: Flexico-France, Henonville (FR)

( * ) Notice: Subject to any disclaimer, the term of this patent is extended or adjusted under 35 U.S.C. 154(b) by 0 days.

(21) Appl. No.: 09/403,778

(22) PCT Filed: Apr. 30, 1998

(86) PCT No.: PCT/FR98/00877

§ 371 Date: Jan. 12, 2000

§ 102(e) Date: Jan. 12, 2000

(87) PCT Pub. No.: WO98/50277

PCT Pub. Date: Nov. 12, 1998

(30) Foreign Application Priority Data

May 5, 1997 (FR) ..... 97 05495

(51) Int. Cl.[7] ..... B65D 33/14

(52) U.S. Cl. ..... 383/25; 383/13; 383/26; 383/24

(58) Field of Search ..... 383/6, 13, 22, 383/24, 25, 26, 27, 30, 31; 16/110.1, 114.1; 24/30.5, 114.5; 294/137

(56) References Cited

U.S. PATENT DOCUMENTS

| | | | | |
|---|---|---|---|---|
| 1,811,866 | | 6/1931 | Rumsey, Jr. . | |
| 3,190,605 | | 6/1965 | Gilbert . | |
| 3,727,830 | * | 4/1973 | Harrison | 383/26 |
| 3,737,945 | * | 6/1973 | Gould | 383/13 X |
| 4,112,541 | * | 9/1978 | Tetradis | 383/26 X |
| 4,155,531 | | 5/1979 | Bagne . | |
| 4,947,523 | * | 8/1990 | Robbins, III et al. | 383/25 X |
| 4,967,451 | * | 11/1990 | Boyn | 383/25 X |

FOREIGN PATENT DOCUMENTS

| | | | | |
|---|---|---|---|---|
| 1 536 103 | * | 5/1971 | (DE) | 383/13 |
| 568872 | * | 4/1945 | (GB) | 383/6 |
| 2042468 | | 9/1980 | (GB) . | |

* cited by examiner

*Primary Examiner*—Jes F. Pascua
(74) *Attorney, Agent, or Firm*—Jacobson, Price, Holman & Stern, PLLC

(57) ABSTRACT

The invention concerns the field of bags provided with a suspending device which can be recycled by the same method as the bag, and enabling automatic assembly. The suspending device is characterized in that it is formed by an integral plastic piece, with a suspending part designed to suspend the bag, formed by a loop, and a fixing part, designed to attach the suspending part to the bag, formed by an element cast en block with the loop adapted to pass through the bag and be maintained thereon. The fixing part shaft is maintained in the holes bored in the bag walls by swaging the fixing part end.

10 Claims, 1 Drawing Sheet

BAG SUSPENDING DEVICE

FIELD OF THE INVENTION

The invention relates to the field of bags fitted with devices enabling them to be hung up.

BACKROUND OF THE INVENTION

Bags are known that have a cord for drawing together the edges of the openings so as to close them. In practice, this primary function of the cord is now associated with the function of suspending the bag.

Such a cord is generally made out of a material that is unsuitable for being recycled by the same method as the bag, and in addition, installing the cord requires manual operation, giving rise to a manufacturing process that is relatively lengthy.

The present invention seeks to mitigate those drawbacks by using a suspension device that is less expensive, that facilitates recycling, and that is suitable for automated assembly.

SUMMARY OF THE INVENTION

According to the invention, the bag suspension device is constituted by a suspensive portion for suspending the bag and by a fixing portion serving to attach the suspensive portion to the bag, and is characterized in that the device is constituted by a single piece of plastics material in which the suspensive portion forms a loop and the fixing portion is formed by an element integrally formed with the loop and adapted to pass through the or each wall of the bag or one or more extensions thereof, and to be held thereto.

The element constituting the suspensive portion is formed by a closed loop. The element which constitutes the fixing portion is advantageously a cylindrical shaft having one end secured to the suspensive portion and its other end free.

The free end can be in the form of a point so as to make it easier to pierce the film constituting the walls of the bag, said film being optionally already pre-pierced. After the fixing portion has been passed through the walls of the bag, its free end is flattened, e.g. by stamping, or is subjected to some other operation that gives this end the function of holding the fixing portion in the holes of said walls. For example, this operation may be performed by melting or by thermally softening the free end of the fixing portion.

The plastics material constituting the device of the invention is selected from the family of materials comprising polyolefins, and more particularly polypropylene or high density polyethylene, associated with respective copolymers such as polyacetal, e.g. as sold under the registered trademark DELRIN®. Such a material has the advantage of being very similar to the material of the plastics film that usually constitutes the bag and of being miscible therewith, so as to enable the entire bag and fixing device assembly to be recycled by a single method.

Another advantage of the device of the invention is that it can be installed automatically.

DESCRIPTION OF THE PREFERRED EMBODIMENTS

Figure 1:
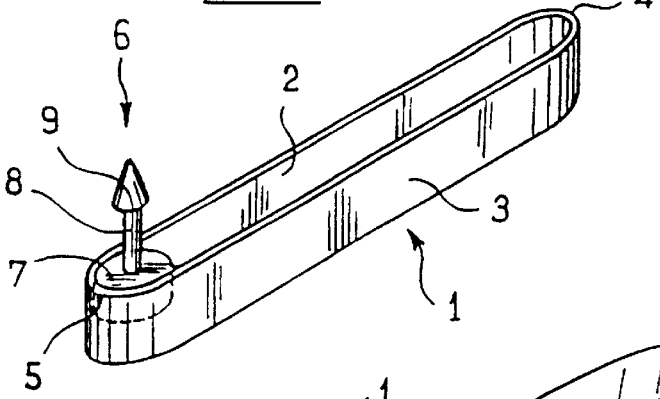
FIG. 1 shows a particular but non-limiting embodiment of the invention as mentioned above.

The device shown in FIG. 1 comprises a suspensive portion 1 and a fixing portion 6.

The suspensive portion 1 is constituted by a closed loop having two parallel rectilinear strands 2 and 3 interconnected at their ends by segments 4 and 5 which are approximately semicylindrical, which are convex towards the outside, and which join the strands 2 and 3 tangentially.

The fixing portion 6 is constituted:

by a cylindrical base 7 which is received in one of the semicylindrical segments 4 or 5 to form a base which is flush with the edge of said segment;

by a cylindrical shaft 8 parallel to the axes of the semicylinders 4 and 5 and perpendicular to the base 7 in which it is centered; and by a point 9 whose diameter at its base is greater than the diameter of the shaft 8 so as to form a catch.

More particularly, the strands 2 and 3 are approximately 40 mm long, 5 mm wide, and 0.5 mm thick.

The semicylindrical segments 4 and 5 have an inside diameter of about 4 mm and the same thickness as the strands 2 and 3.

The base 7 of the fixing portion 6 is 1 mm thick and about 4 mm in diameter. The shaft 8 is 4 mm long and has a diameter of about 1.2 mm. The point 9 is a cone whose base has a diameter of 2 mm and whose height is about 3 mm.

Figure 2:
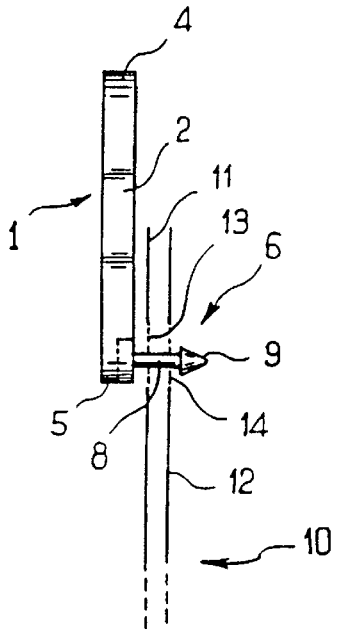
FIG. 2 shows a device of the invention in the position it can occupy when the shaft of the fixing portion is in the holes through the walls of the bag.
Figure 3:
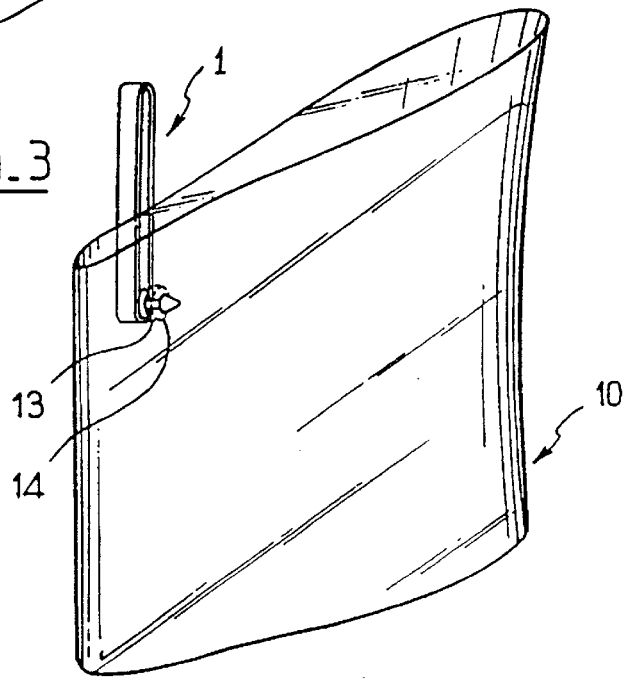
FIG. 3 shows the device of the invention in position on the bag prior to the free end of the fixing portion being flattened.
Figure 4:
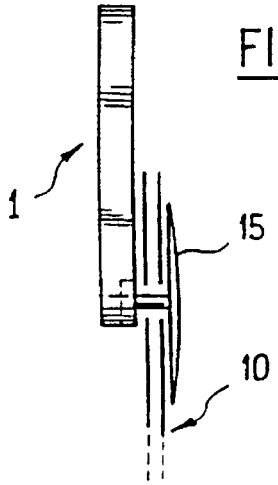
FIG. 4 shows the device of the invention after the free end of the fixing portion has been flattened.

The invention can be fixed to the bag 10 which is to be suspended therefrom as follows:

a) an optional automatic operation of piercing the walls 11 and 12 of said bags ready for said walls 11 and 12 to have the fixing portion 6 pass therethrough;

b) the fixing portion is passed through the walls 11 and 12, with the point 9 passing first (FIGS. 2 and 3); this operation can be performed automatically; and c) when the shaft 8 is in the holes 13 and 14 formed by the point 9 passing through the optionally pre-pierced walls 11 and 12, it is retained therein by an operation which flattens the point 9 so as to obtain a disk 15 of flattened and deformed material having a diameter greater than that of the holes 13 and 14 (FIG. 4).

The device of the invention could be fixed to the bag 10 in other ways. For example, the fixing portion could be attached to an extension of the or each wall 11 (and/or 12) of the bag 10.

Bags that are to be suspended by the device of the invention can be of any type: they can be made of plastics, paper, metal, or any other material suitable for being put into sheet form. The sheets can comprise a single thickness or can be made up of a plurality of layers, optionally made of different materials, with each material being capable of performing a different function.

What is claimed is:

1. A bag suspension device comprising: a suspensive portion for suspending a bag and a fixing portion for attaching the suspensive portion to the bag, the suspensive portion forming a loop and the fixing portion being formed by an element integrally formed with the loop and adapted to pass through the bag and to be held thereto, the loop being formed of two parallel rectilinear strands interconnected by approximately semicylindrical segments and being outwardly convex, and the fixing portion being formed by a shaft having a free end and a base, the base being received in the loop and being flush with an edge of the loop.

2. A bag suspension device according to claim 1, wherein the shaft of the fixing portion is held by the bag and the free end of the fixing portion is flattened externally of the bag.

3. A device according to claim 2, wherein the free end of the fixing portion is flattened by one of stamping, by melting and by thermally softening the free end of the fixing portion.

4. A device according to claim 1, wherein the suspensive portion is made of plastics material selected from the family of materials including polypropylene, high density polyethylene, associated with their respective copolymers, and polyacetal.

5. A device according to claim 1, wherein the shaft is provided with a point at the free end.

6. A device according to claim 5, wherein an axis of the shaft is perpendicular to the base.

7. A device according to claim 1, wherein the fixing portion is received in one of the outwardly convex semicylindrical segments.

8. A device according to claim 1, wherein the strands are about 40 mm long, about 0.5 mm thick, and about 5 mm wide, and the outwardly convex semicylindrical segments have an inside diameter of about 4 mm, and a same thickness as the strands.

9. A device according to claim 1, wherein the base of the fixing portion has a diameter of about 4 mm and a thickness of about 1 mm, the shaft of the fixing portion has a length of 4 mm and a diameter of about 1.2 mm, and a point at the free end of the shaft is a cone whose base is 2 mm in diameter and whose height is approximately 3 mm.

10. A bag fitted with a suspension device according to claim 1.

* * * * *